US011613959B1

(12) United States Patent
McFarlin

(10) Patent No.: US 11,613,959 B1
(45) Date of Patent: Mar. 28, 2023

(54) WIPER PLUG WITH ATMOSPHERIC CHAMBER

(71) Applicant: WEATHERFORD TECHNOLOGY HOLDINGS, LLC, Houston, TX (US)

(72) Inventor: Nicholas W. McFarlin, Odessa, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 17/530,730

(22) Filed: Nov. 19, 2021

(51) Int. Cl.
*E21B 33/16* (2006.01)
*E21B 34/14* (2006.01)

(52) U.S. Cl.
CPC ..... *E21B 33/16* (2013.01); *E21B 34/142* (2020.05)

(58) Field of Classification Search
CPC ..... E21B 34/142; E21B 33/16
See application file for complete search history.

(56) References Cited

U.S. PATENT DOCUMENTS

| | | | | |
|---|---|---|---|---|
| 5,950,725 | A * | 9/1999 | Rondeau | E21B 33/16 166/70 |
| 6,799,638 | B2 | 10/2004 | Butterfield, Jr. | |
| 7,350,582 | B2 | 4/2008 | McKeachnie et al. | |
| RE41,117 | E * | 2/2010 | Treece | E21B 33/16 166/192 |
| 8,025,102 | B2 | 9/2011 | Dewar | |
| 8,789,582 | B2 | 7/2014 | Rondeau et al. | |
| 2014/0224505 | A1* | 8/2014 | Ramon | E21B 23/01 166/376 |
| 2018/0045014 | A1* | 2/2018 | Larisey | E21B 37/10 |
| 2020/0173252 | A1 | 6/2020 | Lende et al. | |
| 2020/0332619 | A1* | 10/2020 | Elliott | E21B 33/12 |

OTHER PUBLICATIONS

Weatherford, "Casing Wiper Plugs and Darts." Brochure, copyright 2013, 58-pages.
Weatherford, "Mk5 SWP Single Wiper Plug with Integral Ball Seat," Brochure, copyright 2006, 2-pages.
Weatherford, "Reducing Well Preparation Costs for Fracturing Horizontal Wells," Brochure, copyright 2011-2014, 2-pages.

* cited by examiner

*Primary Examiner* — Christopher J Sebesta
(74) *Attorney, Agent, or Firm* — Cabello Hall Zinda, PLLC

(57) ABSTRACT

A wiper plug is used in an operation to cement tubing in a borehole. The wiper plug is pumped down the tubing to separate an advancing fluid from a following fluid of the cementing operation, and an internal pressure chamber is maintained in a throughbore of the wiper plug between uphole and downhole barriers. The wiper plug eventually lands in the tubing, and the uphole barrier is removed by applying a first predetermined pressure against the uphole barrier. Removal of the uphole barrier is facilitated by the known and controlled internal pressure of the plug's chamber. The downhole barrier is also removed so that flow is permitted through the throughbore of the wiper plug. To perform a tubing pressure test, the downhole barrier can be removed due to pressure, and the chamber may have a temporary valve to hold applied pressure to a test level. Alternatively, the downhole barrier can hold the applied pressure. The temporary valve and the downhole barrier can then be self-removing in response to a stimulus.

21 Claims, 7 Drawing Sheets

WIPER PLUG WITH ATMOSPHERIC CHAMBER

BACKGROUND OF THE DISCLOSURE

A tubing string cemented in a borehole must withstand the pressures in which the tubing string is designed to be used. For this reason, operators want to test the integrity of the tubing string once the tubing is cemented in the borehole. This testing can be performed by deploying a plug, such as a ball, down the tubing string, landing the ball on a seat downhole, and increasing the tubing pressure behind the seated ball up to a particular test level. Unfortunately, performing a full pressure check on the tubing string is not always feasible using a deployed plug after completing a cementing operations. For this reason, a full pressure check may not be performed in some conventional implementations.

The subject matter of the present disclosure is directed to overcoming, or at least reducing the effects of, one or more of the problems set forth above.

SUMMARY OF THE DISCLOSURE

A wiper plug for use in downhole pressures comprises a body, a downhole barrier, an uphole barrier, and a chamber. The body defines a throughbore from an uphole end to a downhole end. The downhole barrier is disposed in the throughbore toward the downhole end, and the uphole barrier is disposed in the throughbore toward the uphole end. The chamber is enclosed in the throughbore between the uphole and downhole barriers and is configured to hold an internal pressure lower than the downhole pressures. The uphole barrier is removable in response to a first pressure, which is predefined by the internal pressure of the chamber. The downhole barrier is removable.

The wiper plug can further comprise wipers disposed externally on the body. The wiper plug can also further comprise a temporary valve disposed in the throughbore. The temporary valve is configured to at least temporarily prevent pressure communication therethrough from the uphole end to the downhole end. The temporary valve can include: a seat disposed in the throughbore; and a ball disposed in the throughbore and being configured to seat in the seat, the ball being self-removing. The temporary valve can be comprised of a self-removable material being removable in response to a stimulus. For example, the self-removable material can be configured to dissolve, erode, disintegrate, or degrade due to heat, temperature, fluid, introduced solvent, applied acid, time, and/or a wellbore condition as the stimulus.

The uphole barrier can include a breachable plug, a frangible barrier, a rupture disc, a shearable plug, or a pump-out barrier; and wherein the downhole barrier comprises a breachable plug, a frangible barrier, a rupture disc, a shearable plug, a pump-out barrier.

The wiper plug can include: a first seal configured to seal between the uphole barrier and the throughbore; and a second seal configured to seal between the downhole barrier and the throughbore.

The downhole barrier can be removable in response to a second pressure force; and the first pressure force can be configured to be at least greater than the second pressure force. At least a portion of the downhole barrier can be comprised of a self-removable material being removable in response to a stimulus introduced through removal of the uphole barrier.

A method disclosed herein comprises: pumping a wiper plug down tubing; maintaining an internal pressure chamber in a throughbore of the wiper plug between uphole and downhole barriers; landing the wiper plug in the tubing; removing the uphole barrier by applying a first predetermined pressure against the uphole barrier and facilitating removal of the uphole barrier with the internal pressure chamber of the wiper plug; removing the downhole barrier; and permitting flow through the throughbore of the wiper plug in response to removal of the uphole and downhole barriers.

A method disclosed herein of performing a cementing operation for tubing in a borehole comprise: pumping a first wiper plug separating an advancing fluid from a following fluid of the cementing operation down the tubing; maintaining a first internal pressure chamber in a first throughbore of the first wiper plug between a first uphole barrier and a first downhole barrier; landing the first wiper plug in the tubing; removing the first uphole barrier by applying a first predetermined pressure against the first uphole barrier and facilitating removal of the first uphole barrier with the first internal pressure chamber of the first wiper plug; removing the first downhole barrier; and permitting flow through the first throughbore of the first wiper plug in response to removal of the first uphole and downhole barriers.

The foregoing summary is not intended to summarize each potential embodiment or every aspect of the present disclosure.

DETAILED DESCRIPTION OF THE DISCLOSURE

Figure 1:
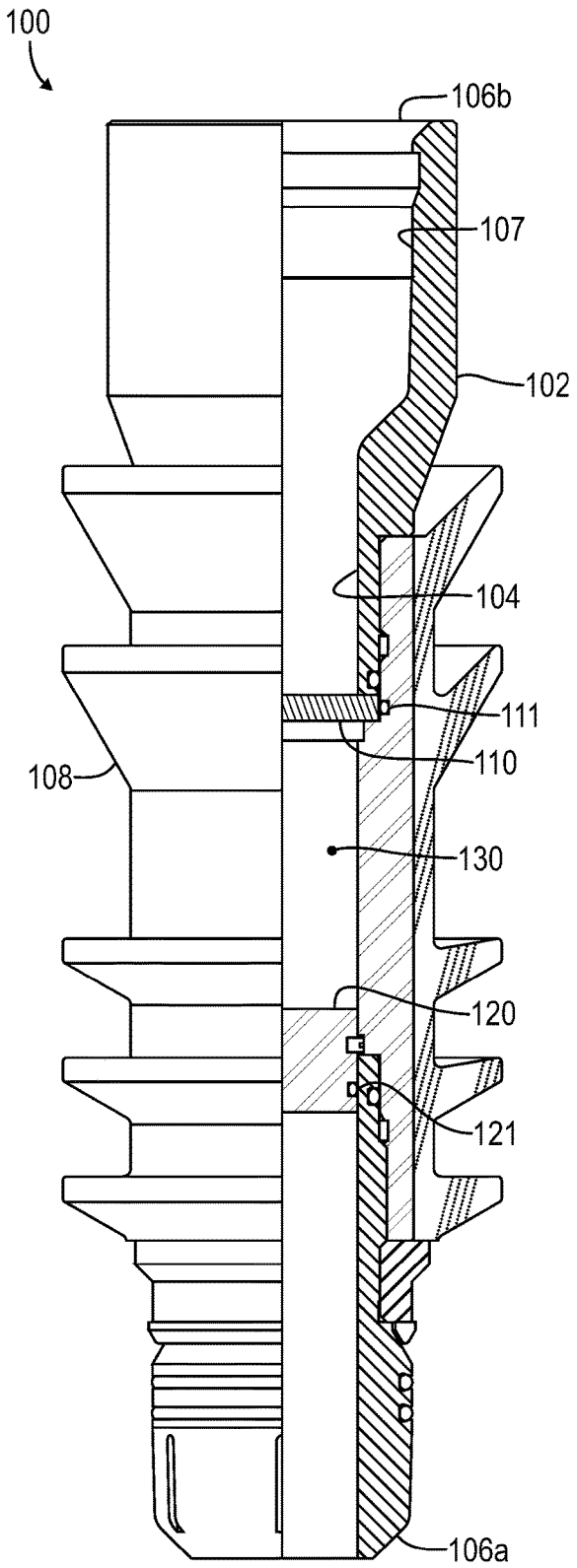
FIG. 1 illustrates an embodiment of a wiper plug according to the present disclosure in partial cross-section.

FIG. 1 illustrates an embodiment of a wiper plug 100 according to the present disclosure in partial cross-section. The wiper plug 100 is for use in downhole pressures, such as when cementing tubing in a borehole. In the cementing operation, the wiper plug 100 allows for displacement through the wiper plug 100 after a high precision pressure activation.

The wiper plug 100 includes a body 102, an uphole barrier 110, a downhole barrier 120, and an internal chamber 130.

The body 102, which is typically cylindrical and can be comprised of several connected components, defines a throughbore 104 from an uphole end 106*b* to a downhole end 106*a*. To engage and wipe an interior of tubing (not shown) in which the wiper plug 100 is deployed, the body 102 includes a number of wipers or fins 108 disposed externally on the body 102.

The downhole barrier 120 is disposed in the throughbore 104 toward the downhole end 106*a*, and the uphole barrier 110 disposed in the throughbore 104 toward the uphole end 106*b*. The internal chamber 130 is enclosed in the throughbore 104 between the uphole and downhole barriers 110, 120 and is configured to hold an internal pressure lower than the downhole pressures expected during use of the wiper plug 100. For example, the internal chamber 130 can hold atmospheric pressure trapped inside the chamber 130 during assembly of the wiper plug 100. Any other suitable pressure can be used.

The uphole barrier 110 is removable in response to a first pressure force. In general, the uphole barrier 110 can be a breachable plug, a frangible barrier, a rupture disc, a shearable plug, a pump-out barrier, or the like. To hold pressure for the internal chamber 130, a seal arrangement 111 can be configured to seal between the uphole barrier 110 and the throughbore 104.

The downhole barrier 120 is removable in response to a second pressure force. This second pressure force can be the same as or lower than the first pressure force. In general, the downhole barrier 120 can be a breachable plug, a frangible barrier, a rupture disc, a shearable plug, a pump-out barrier, or the like. To hold pressure for the internal chamber 130, a seal arrangement 121 can also be configured to seal between the downhole barrier 120 and the throughbore 104.

Accordingly, the wiper plug 100 includes a high-pressure barrier 110 toward the uphole end 106*b* and includes a lower-pressure barrier 120 toward the downhole end 106*a*. The atmospheric pocket trapped in the chamber 130 between the barriers 110, 120 allows for high-precision activation of the uphole barrier 110.

In the current configuration, the high-pressure uphole barrier 110 disposed toward the uphole end 106*b* is used for high pressure activation. Accordingly, the uphole barrier 110 is removable in response to a pressure force that may greater than what is needed to remove/yield the downhole barrier 120. The atmospheric chamber 130 enclosed inside the body 102 between the two barriers 110, 120 produces internal conditions behind the uphole barrier 110 that can be particularly defined and preconfigured.

As discussed below, the pressure force is applied against the uphole barrier 110 once the wiper plug 100 has landed and uphole tubing pressure is increased. Because the uphole barrier 110 separates this increased uphole tubing pressure from the lower pressure in the internal chamber 130, the pressure required to remove/yield the uphole barrier 110 is predefined by the internal pressure of the chamber 130. This allows for high precision activation against the atmospheric chamber 130. For example, the uphole barrier 110 can be configured to be removed by a particular tubing pressure rated against the known and controlled atmospheric chamber 130 on the opposite side of the uphole barrier 110. Therefore, an activation pressure can be selected that is independent of the fluid used to displace the plug 100 to the landing depth. This results in a predictable hydrostatic pressure above, and the ability to very precisely determine a yield pressure for the uphole barrier 110 to rupture the atmospheric chamber 130.

In general, the downhole barrier 120 is used primarily to maintain the atmospheric pressure in the internal chamber 130. Therefore, the downhole barrier 120 needs to withstand at least the hydrostatic pressures that occur during pump-down of the plug 100 and that are expected downhole. For this reason, the predetermined pressure required to remove the downhole barrier 120 may be less than that required for the uphole barrier 110. Accordingly, this barrier 120 supports the atmospheric chamber 130 and can be removed/ruptured/displaced out at a low pressure.

Figure 2:
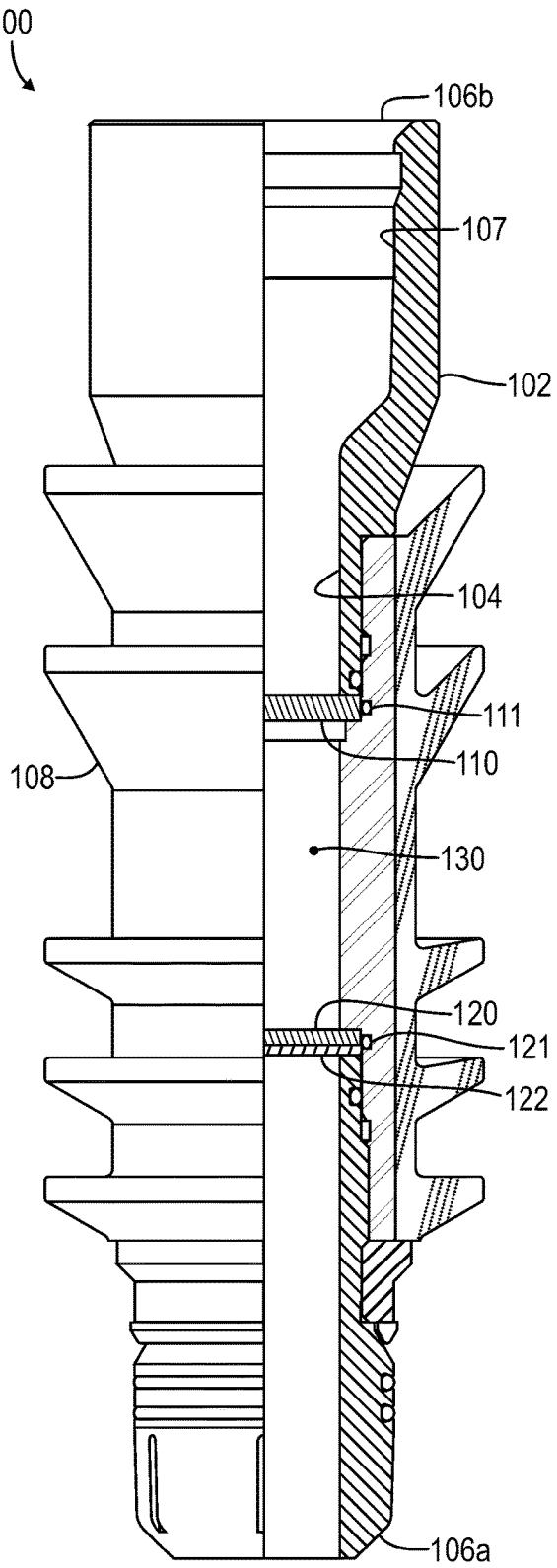
FIG. 2 illustrates another embodiment of a wiper plug according to the present disclosure in partial cross-section.

FIG. 2 illustrates another embodiment of a wiper plug 100 according to the present disclosure in partial cross-section. This wiper plug 100 is similar to that discussed previously so that like reference numbers are used, but not necessarily described again.

Similar to the previous configuration, this wiper plug 100 includes uphole and downhole barriers 110, 120 to hold an internal pressure in a chamber 130. In one configuration, both barriers 110, 120 are rupture discs or the like with the uphole barrier 110 breached by a same or greater pressure force compared to the downhole barrier 120.

In another configuration, the uphole barrier 110 is a rupture disc or the like, but the downhole barrier is a type of self-removing plug to withstand a higher pressure. In this configuration, the uphole barrier 110 can be removed as before with the internal pressure of the chamber 130 facilitating the removal. However, the downhole barrier 120, which encloses the chamber 130, can be configured to hold a greater pressure, which allows for this wiper plug 100 to be used for tubing pressure testing.

In particular, the downhole barrier 120 may not be removable (i.e., frangible, ruptured, breachable) at increased pressures for a tubing pressure test. Instead, the downhole barrier 120 may withstand an increase tubing pressure used for testing, but can be self-removable (e.g., degradable) over time to eventually open up fluid communication through the wiper plug's throughbore 104 so further operational steps can be performed. For example, the downhole barrier 120 may be degradable in response to a stimulus, such as contained in a following fluid behind the wiper plug 100. This stimulus can enter the chamber 130 once the uphole barrier 110 is removed so the stimulus can begin to degrade, disintegrate, or otherwise remove the downhole barrier 120.

In a cementing operation, for example, this following fluid having the stimulus can be the displacement fluid used to pump the wiper plug 100 downhole behind a retarding fluid. In this instance, the degradable downhole barrier 120 may not be degradable in response to the advancing retarding fluid pumped ahead of the plug 100, but may be degradable in the displacement fluid or by an additive to the displacement fluid.

As a further variation, the downhole side 122 of the downhole barrier 120 may have a coating or layer of material that is not degradable in the presence of the advancing fluid. Yet, the material on this downhole side 122 may not be structurally robust, allowing it to yield once the other portion 124 of the barrier 120 degrades. This material on this downhole side 122 can prevent the advancing fluids from degrading the barrier 120, which would then only start to degrade once the uphole barrier 110 is removed and fluid interacts with the uphole side 124 of the barrier 120.

Figure 3:
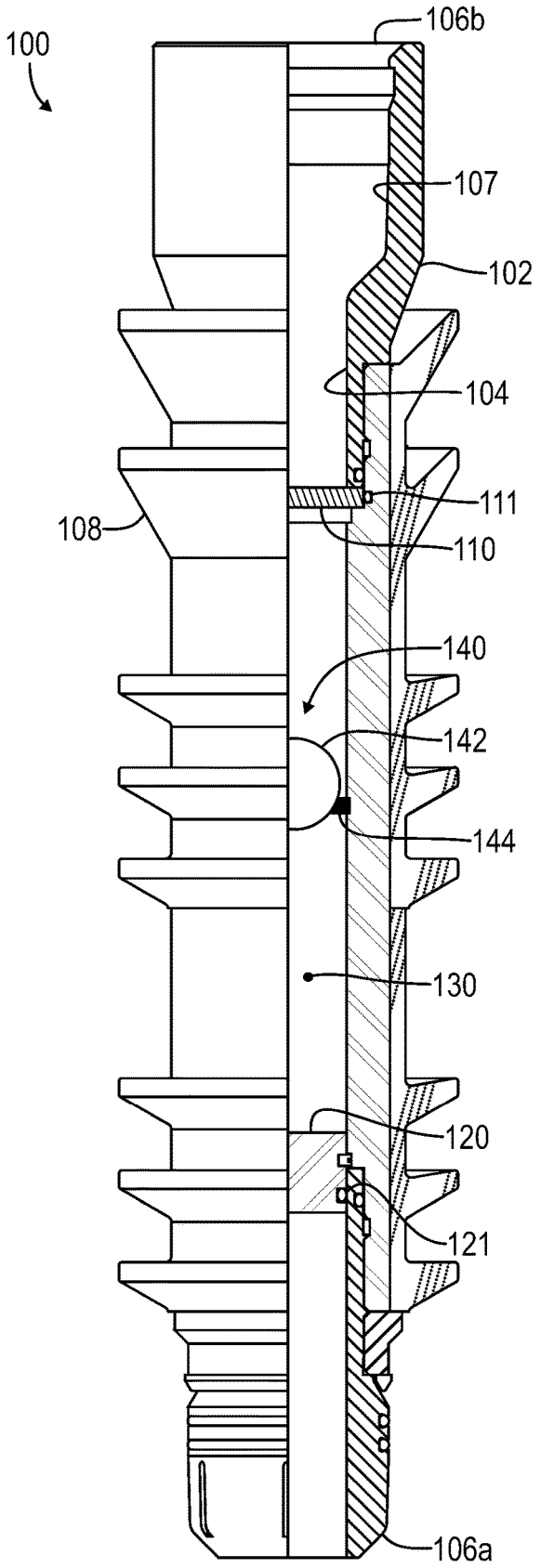
FIG. 3 illustrates yet another embodiment of a wiper plug according to the present disclosure in partial cross-section.
Figure 4:
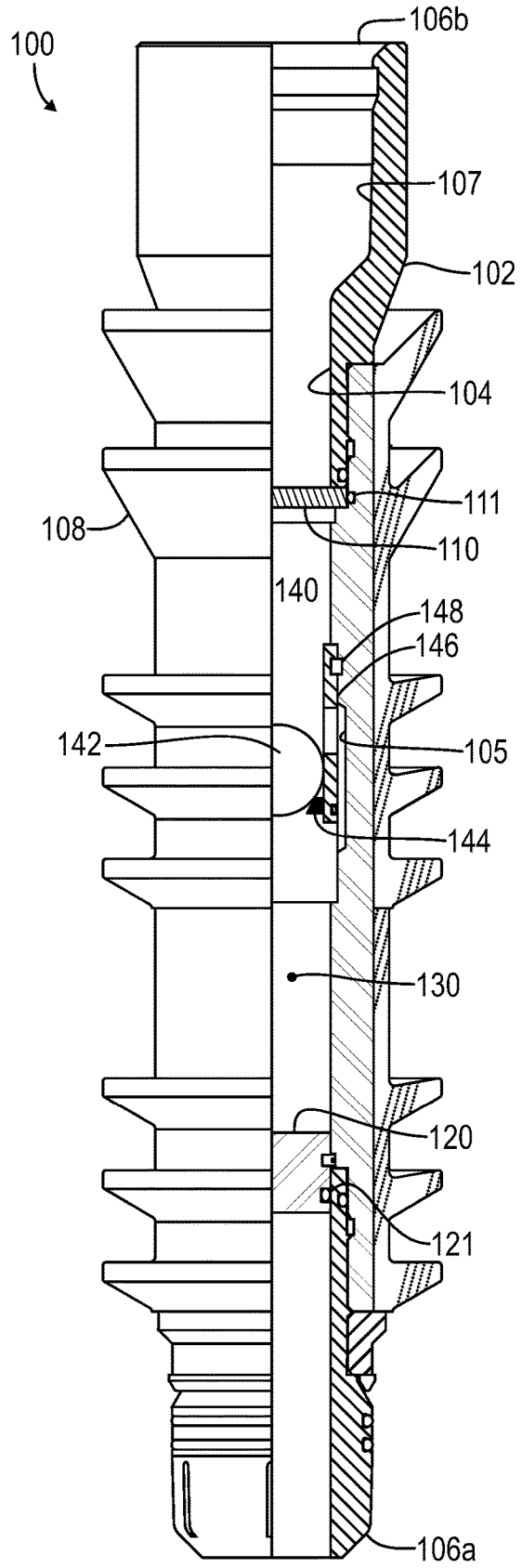
FIG. 4 illustrates yet another embodiment of a wiper plug according to the present disclosure in partial cross-section.

FIGS. 3-4 illustrate other embodiments of wiper plugs 100 according to the present disclosure in partial cross-section. These wiper plugs 100 are similar to those discussed previously so that like reference numbers are used, but not necessarily described again. These wiper plugs 100 allow for displacement through the wiper plugs 100 after a high precision pressure activation and enable a high-pressure test to be performed. As discussed later, the wiper plugs 100 can be used in conjunction with a wet shoe plug system as a top plug and a testing option.

As shown in FIGS. 3-4, these wiper plugs 100 further include a temporary valve 140 disposed in the throughbore 104. For instance, the temporary valve 140 can be disposed in the internal chamber 130 between the barriers 110, 120. The temporary valve 140 is configured to at least temporarily prevent pressure communication through the plug's throughbore 104 from the uphole end 106*b* to the downhole end 106*a* once the barriers 110, 120 are removed.

The wiper plugs 100 in FIGS. 3-4 can be used similar to the other plugs 100 disclosed herein. When the plug 100 is landed, the uphole barrier 110 can be removed with the predetermined pressure predefined by the lower pressure of the internal chamber 130. The downhole barrier 120 used for maintaining the internal chamber 130 can be removed as before. However, the temporary valve 140 when closed by increased uphole pressure can then provide a pressure barrier allowing for a tubing pressure test to be performed uphole of the wiper plug 100. The temporary valve 140 is then dissolvable or degradable over time due to exposure of a stimulus, such as the downhole fluids, so that fluid communication through the wiper plug 100 can eventually be achieved to complete operations.

In general, the temporary valve 140 can use a dissolvable or degradable medium placed within the atmospheric chamber 130. The medium of the valve 140 does not dissolve or degrade until exposed to the downhole fluids once the uphole barrier 110 has been removed. For example, an aggressive dissolvable metal chemistry can be used, such as aluminum and magnesium alloys or other dissolvable metals.

Being self-removing, the temporary valve 140 is composed of a self-removable material that degrades, dissolves, disintegrates, or otherwise removes in time to re-establish flow through the throughbore 104 so subsequent operations can be performed. Reference herein to a self-removable material is meant to encompass any materials designed to dissolve, erode, disintegrate, or otherwise degrade over time and/or in certain wellbore conditions due to heat, temperature, hydrocarbon composition, introduced solvent, applied acid, or other factors. For example, the temporary valve 140 can be composed of a dissolvable, degradable, disintegrable, or other self-removable material known in the art when subjected to appropriate conditions, such as a temperature for a period of time, an introduced acid or other fluid, the existing wellbore fluid, etc. For example, the material of the temporary valve 140 can be aluminum, a reactive metal, a magnesium alloy, a degradable composite polymer, a polystyrene, an elastomer, a resin, an adhesive, a polyester, a polymide, a thermoplastic polymer, a polyglycolide, a polyglycolic acid, a thermosetting polymer, or the like, such as used for fracture balls.

In general, the temporary valve 140 can be a plug element, a ball, or other barrier of the self-removable material. In the example of FIG. 3, the temporary valve 140 can be a check valve arrangement that includes a ball 142 and a seat 144. The internal ball seat 144 is disposed in the throughbore 104, and the ball 142 trapped inside the chamber 130 in the throughbore 104 is configured to engage in the seat 144. The ball 142 is self-removing (e.g., dissolvable or degradable) in response to a stimulus, such as disclosed herein.

The ball 142 and seat 144 in the chamber 130 can be used for a high-pressure test during operations and is not activated until the uphole barrier 110 is removed. For example, after the uphole barrier 110 is removed/yields, fluid fills the atmospheric space of the chamber 130, the downhole barrier 120 displaces out, and the ball 142 composed of the self-removable material would be able to engage in the seat 144. This would allow for a high pressure test of tubing pressure to be applied against the seated ball 142. Controlled activation of the self-removable material of the ball 142 would then allow displacement to resume after an expected exposure time. Other configurations can be used.

In this way, the wiper plug 100 having the temporary valve 140 allows for a pressure test to be applied without the need to displace a frac plug or ball down a tubing string to a toe of the tubing string for the sole purpose of performing a pressure test. Instead, the temporary valve 140, such as the trapped ball 142 and seat 144, allows for a high-pressure test to be performed straightaway after cementing, and delayed injection access can be eventually achieved without needing to increase pressure beyond the desired test pressure for testing the tubing integrity.

As noted, removing/yielding of the uphole barrier 110 on the wiper plug 100 can displace or pump-out the downhole barrier 120. To at least allow fluid and pressure to pass temporarily from the removed uphole barrier 110 and to communicate against the downhole barrier 120 for its removal, an arrangement of a sliding sleeve, seals, and flutes can be used.

In this example, the wiper plug 100 in FIG. 4 uses an arrangement of a sliding sleeve 146, shear pins 148, seals, and flutes 105 with a ball 142 and a seat 144 to at least allow fluid and pressure to pass temporarily from the removed uphole barrier 110 and to communicate against the downhole barrier 120 for its removal. Other configurations can be used that will allow the temporary valve to stay open at least temporarily to allow pressure entering the chamber 130 to act against the downhole barrier 120 to remove the barrier.

For example, removal of the uphole barrier 110 by the increased tubing pressure uphole of the plug 100 allows fluid to enter the atmospheric chamber 130. The ball 142 would tend to engage the seat 144 and prevent communication of pressure to the downhole barrier 120. However, the seat 144 here is disposed in a sliding sleeve 146 that allows a bypass of fluid to communicate to the downhole barrier 120 to facilitate its removal. Eventually, shear pins 148 on the sliding sleeve 146 can shear free, and the sliding sleeve 146 can shift and seal in the throughbore 104 to prevent fluid communication so pressure testing can be performed. This and other configurations can be used.

Having an understanding of various embodiments of wiper plugs 100 according to the present disclosure, discussion now turns to an example cementing operation using the disclosed wiper plug 100.

FIGS. 5A-5E show an assembly for cementing a tubing string 20 in a borehole 10. The assembly can use at least one of the wiper plugs 100 of the present disclosure during a cementing operation. In the current example, the assembly uses three of the disclosed wiper plugs 100*a-c* to place a volume of cement (C) in the annulus 12 for zonal isolation and to place a retarding fluid (R) at the toe of the float valve 30 for communication with the formation.

In the assembly of FIGS. 5A-5E, each of the wiper plugs 100*a-c* includes a low pressure chamber 130 between the uphole and downhole barriers 110, 120. The barriers 110, 120 can be field-adjustable so the plugs 100*a-c* can be configured for particular well conditions and specific activation pressures. As will be appreciated, the disclosed wiper plugs 100*a-c* can be used in other configurations, and more or less of the disclosed wiper plugs 100*a-c* can be used.

Moreover, the disclosed wiper plug 100*a-b* can be used with other types of plugs used in the art. For example, the final wiper plug 100*c* can have dual barriers 110, 120 enclosing a chamber 130 as shown, while the first and second wiper plugs 100*a-b* may only include one temporary barrier (e.g., 110) and may not have dual barriers 110, 120 enclosing a chamber 130. In another example, the final wiper plug 100*c* can further include a temporary valve 140, while the first and second wiper plugs 100*a-b* may not.

Figure 5A:
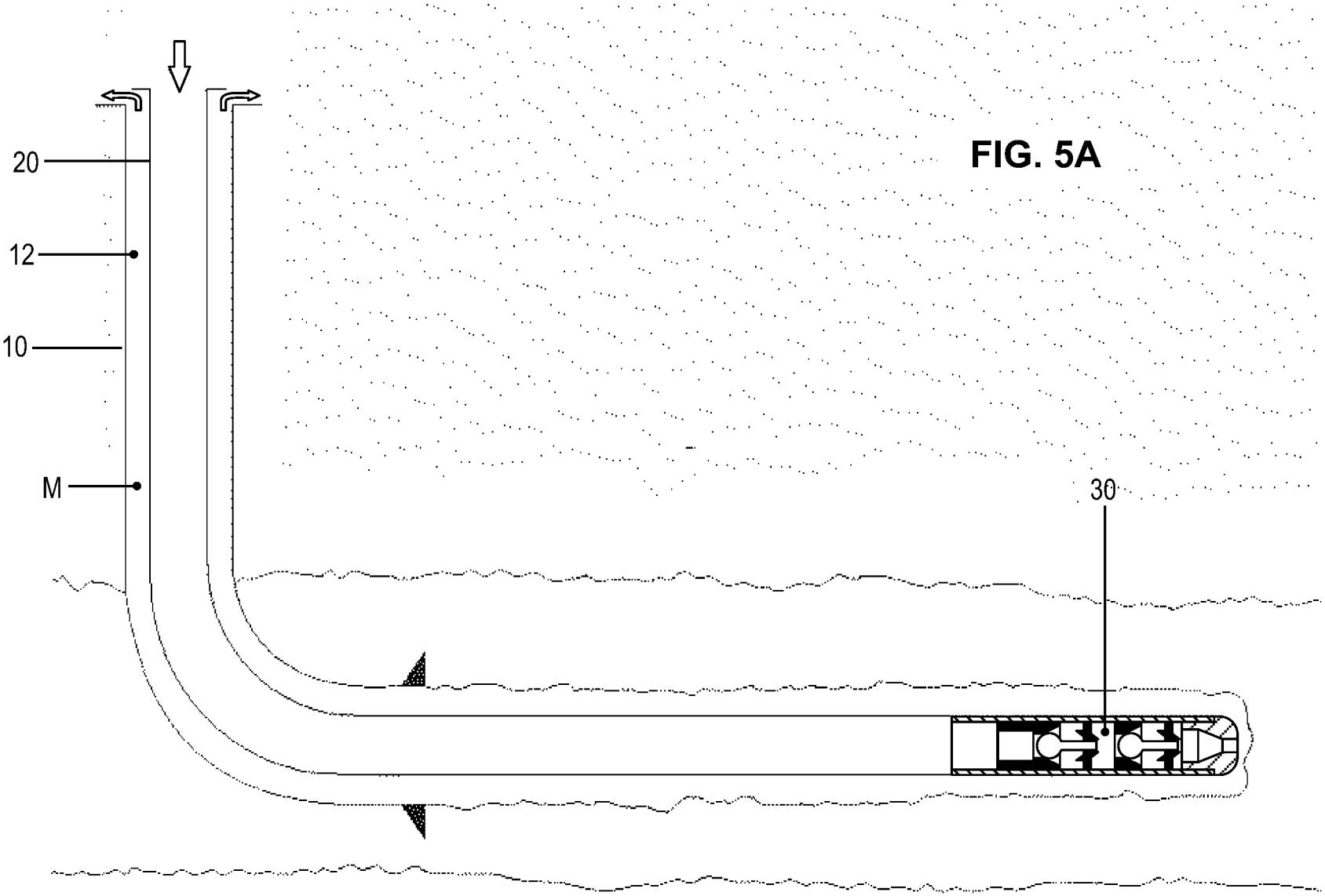
FIG. 5A illustrates a tubing string disposed in a borehole and having a float valve towards the toe.

Looking at the cementing operation exemplified herein, FIG. 5A illustrates the tubing string 20 disposed in the borehole 10 and having the float valve 30 towards the toe. The tubing string 20 referred to here may be casing, production tubing, liner, tubulars, or the like. Mud (M) is pumped down the tubing 20 and out of the float valve 30 so the mud can travel back up the annulus 12 to clear the borehole 10.

Figure 5B:
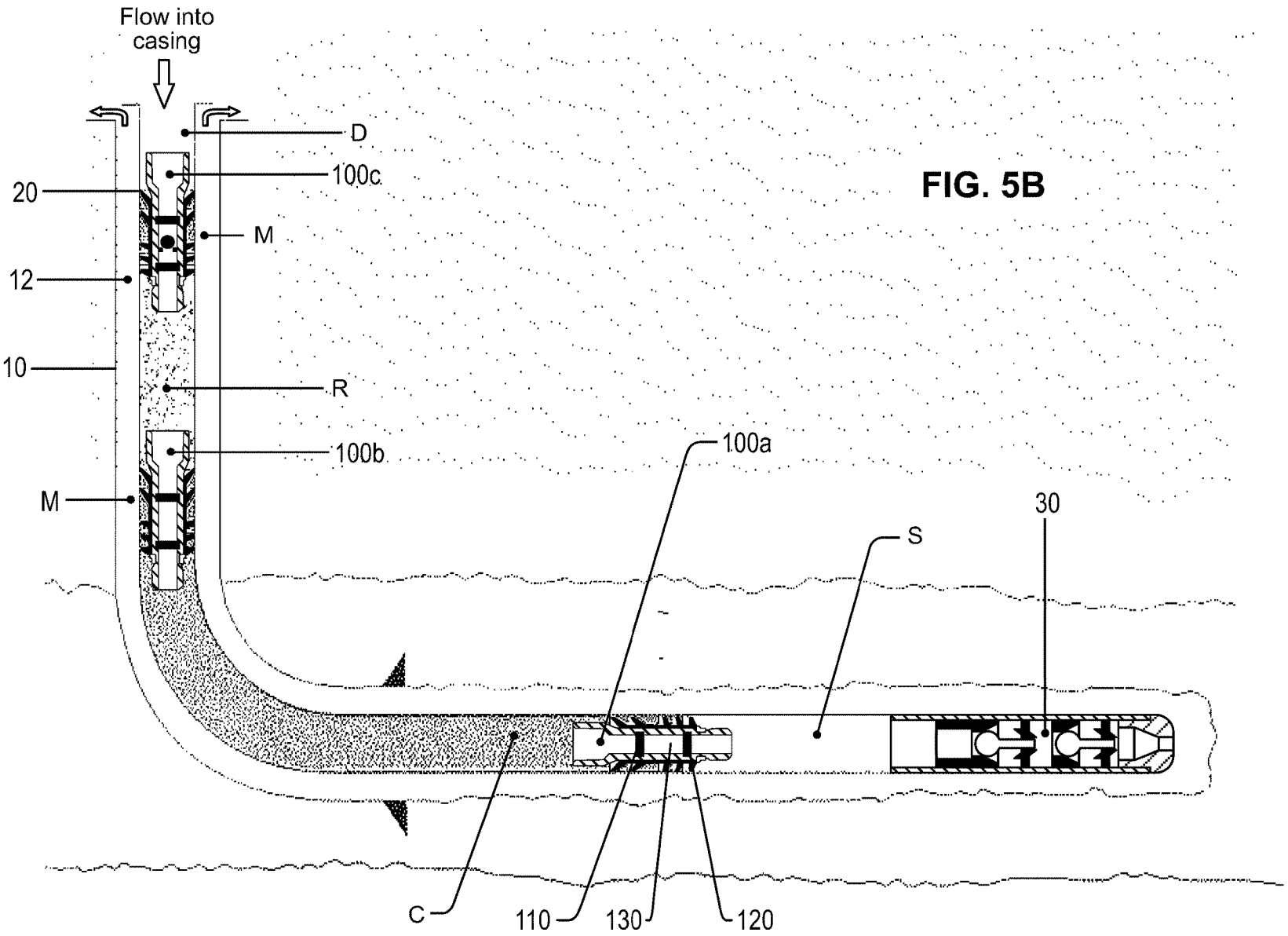
FIG. 5B illustrates a first stage of cementing the tubing string in the borehole in which a spacer fluid, a cement slurry, a retarding fluid, and a displacement fluid are pumped into the tubing string using the disclosed wiper plugs.

As shown in FIG. 5B, a first stage of cementing the tubing string 20 in the borehole 10 involves pumping a first fluid slug of a spacer fluid (S) down the tubing string 20 followed by a first wiper plug 100*a* of the present disclosure. As will be appreciated, cementation equipment (not shown) is typically used at surface for pumping fluid and deploying plugs. The first wiper plug 100*a* is pumped down the tubing string 20 and separates the advancing spacer fluid (S) from a following slug of cement slurry (C).

Behind the cement slurry (C), a second wiper plug 100*b* of the present disclosure is pumped by a retarding fluid (R). Finally, a final wiper plug 100*c* of the present disclosure is pumped behind the retarding fluid (R) using a displacement fluid (D). During this process, the mud (M) in the tubing string 20 is displaced by these advancing fluids (S, C, R, D), and the spacer fluid (S) eventually reaches the float valve 30 to travel into the borehole annulus 12. The cement (C) and other pumped fluids (S, R, D) may be supplied through a work string (not shown) or the tubing string 20 if the work string is removed.

In general, the float valve 30 at the toe may be a one-way valve or a check valve, such as a float valve/collar, that permits fluid flow out of the tubing string 20 and into the borehole 10, while preventing fluid flow into the tubing string 20 from the borehole 10. As shown here, the float valve 30 can be a dual-valve float shoe to provide redundant control of possible backpressure.

As shown, the first plug 100*a* is run ahead of the cement (C) to prevent contamination while being displaced through the tubing string 20. The second plug 100*b* separates the advancing cement slurry (C) from the following retarding fluid (R), and the final plug 100*c* is placed behind the advancing retarding fluid (R). Each of the wiper plug 100*a-c* includes a low pressure (atmospheric) chamber 130 isolated between uphole and downhole barriers 110, 120. While the wiper plugs 100*a-c* are being pumped, the lower pressure in the internal chamber 130 is maintained.

Figure 5C:
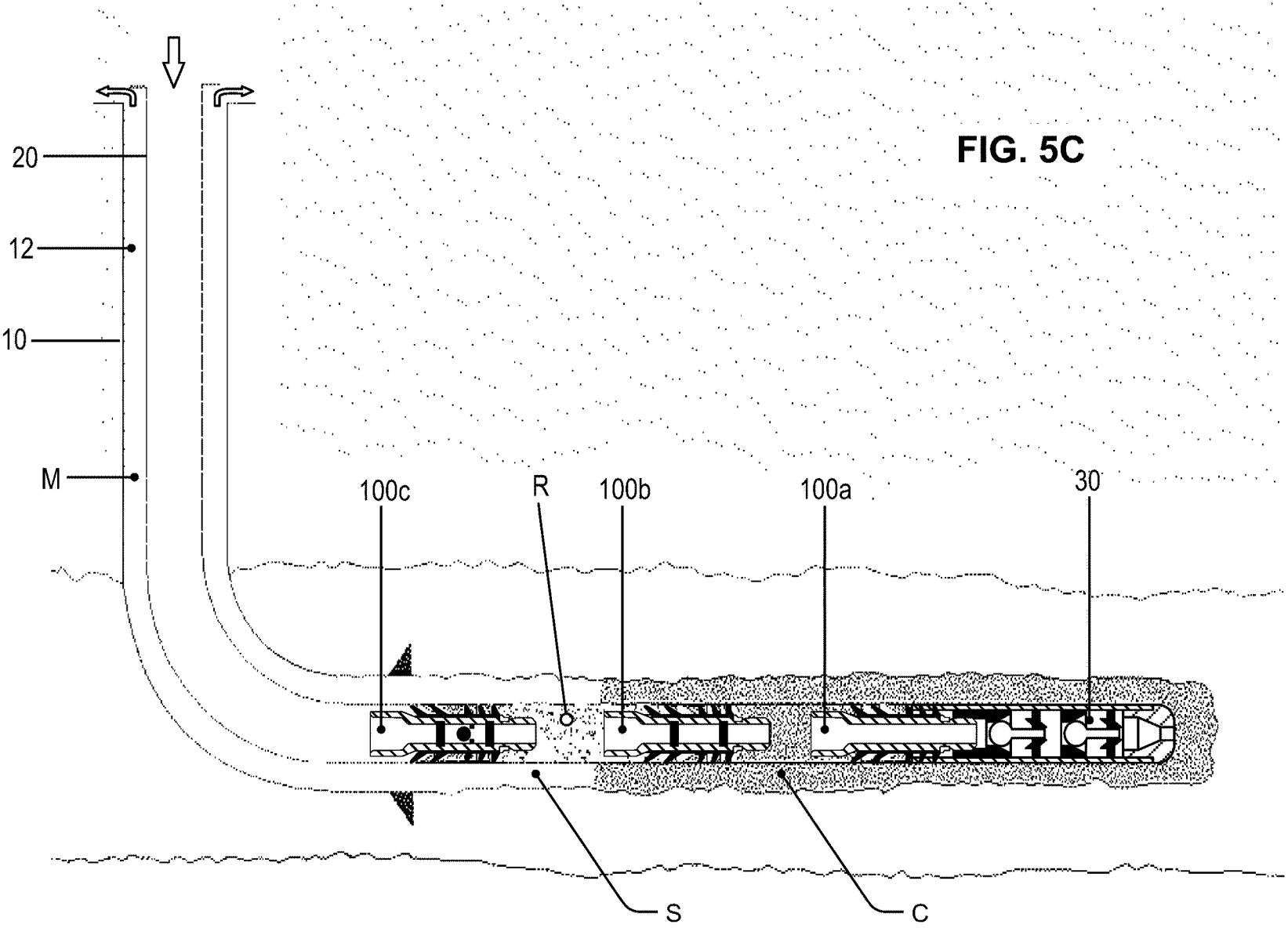
FIG. 5C illustrates a second stage of cementing the tubing string in the borehole in which a first of the disclosed wiper plugs lands at the float valve.

As then shown in FIG. 5C, the first wiper plug 100*a* lands on the float valve 30 in the tubing string 20 and seats. The float valve 30 and plug 110*a* can include a latch and seal mechanism to retain and seal the wiper plug 100*a* when landed. The pressure from the following cement slurry (C) eventually removes the first uphole barrier 110 from this wiper plug 100*a*. For example, the uphole barrier 110 is ruptured, breached, or otherwise removed by application of a first predetermined pressure against the first uphole barrier 110. As noted, the removal is facilitated because the barrier 110 is backed by the known and controlled low pressure in the internal chamber 130. The downhole barrier 120 of the first wiper plug 100*a*, which maintained the chamber 130, is also removed with a predetermined pressure, typically lower than required to remove the uphole barrier 110. Fluid flow is now permitted through the throughbore 104 of the first wiper plug 100*a* so that the cement slurry (C) can flow through the first wiper plug 100*a* and out the float valve 30 to the annulus 12.

As disclosed herein, the barriers 110, 120 can be configured to rupture, breakup, shatter, etc. at accurate pressures. As will be appreciated, the removal of the barriers 110, 120 is designed to not damage or hinder operation of the float valve 30. Accordingly, proper selection of the barriers 110, 120 is made. As also disclosed, it is feasible for the first wiper plug 100*a* to have only one barrier 110 without a chamber (130) and without a second barrier (120) as long as removal of the barrier 110 can be assured.

Figure 5D:
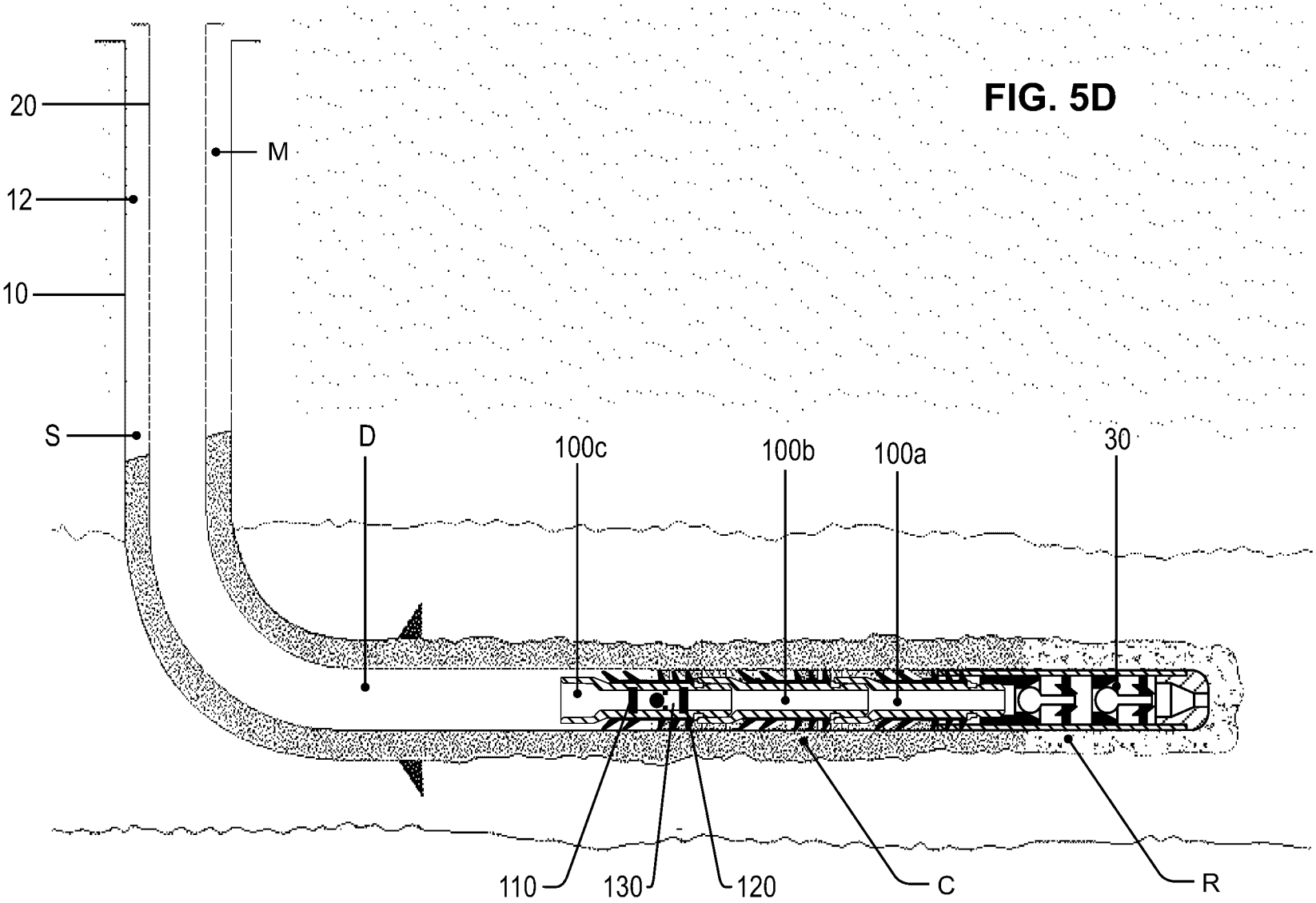
FIG. 5D illustrates a third stage of cementing the tubing string in the borehole in which the disclosed wiper plugs are all landed.

As shown in FIG. 5D, the second wiper plug 100*b* eventually lands in the first wiper plug 100*a*, and a latch and seal mechanism between the plugs 100*a-b* can retain and seal the wiper plug 100*b* when landed. The plug's barriers 110, 120 are removed in a similar manner by the applied pressure. As will be appreciated, the removal of the barriers 110, 120 is designed to not obstruct flow in the downstream wiper plug 100*a* nor to damage or hinder operation of the float valve 30. As also disclosed, it is feasible for the second wiper plug 100*b* to have only one barrier 110 without a chamber (130) and without a second barrier (120) as long as removal of the barrier 110 can be assured.

The retarding fluid (R) can flow through the two plugs 100*a-b*, out the float valve 30, and into the toe of the borehole 10. The cement slurry (C) is forced up the annulus 12 between the tubing string 20 and borehole 10 to fix the tubing string 20 in place once hardened.

As is known, the retarding fluid (R) retards the hardening of the cement slurry (C) at the toe so fluid communication with the borehole 10 can be achieved. In this case, operators may use a "wet shoe" at the end of tubing string 20 where cement (C) does not set around or obstruct the float valve 30 at the end of the tubing string 20. After cementing, fluid communication can remain established through the tubing string 20 and the float valve 30 into the borehole 10. In this way, the wet shoe enables operators to conduct subsequent operations after cementing, such as pumping down plugs or perforating guns to the toe of the tubing string 20.

During use, the tubing string 20 must withstand pressures for which the tubing string 20 is designed to be used. In conventional practice, testing the integrity of the tubing string 20 can be performed using a self-removing plug (not shown), such as a ball, deployed down the tubing string 20 and landed on a seat of the final wiper plug 100*c*. When completing the wet shoe application, however, performing a full pressure check on the tubing string 20 is not always feasible using such a deployed plug. For this reason, a full pressure check may not be performed in conventional implementations. As will be appreciated, however, the tubing string 20 is subject to pressure changes and cycles during its operational life, and the structural integrity of the tubing string 20 must be maintained. Therefore, being able to the check the integrity of the tubing string 20 with a pressure check is preferred.

Figure 5E:
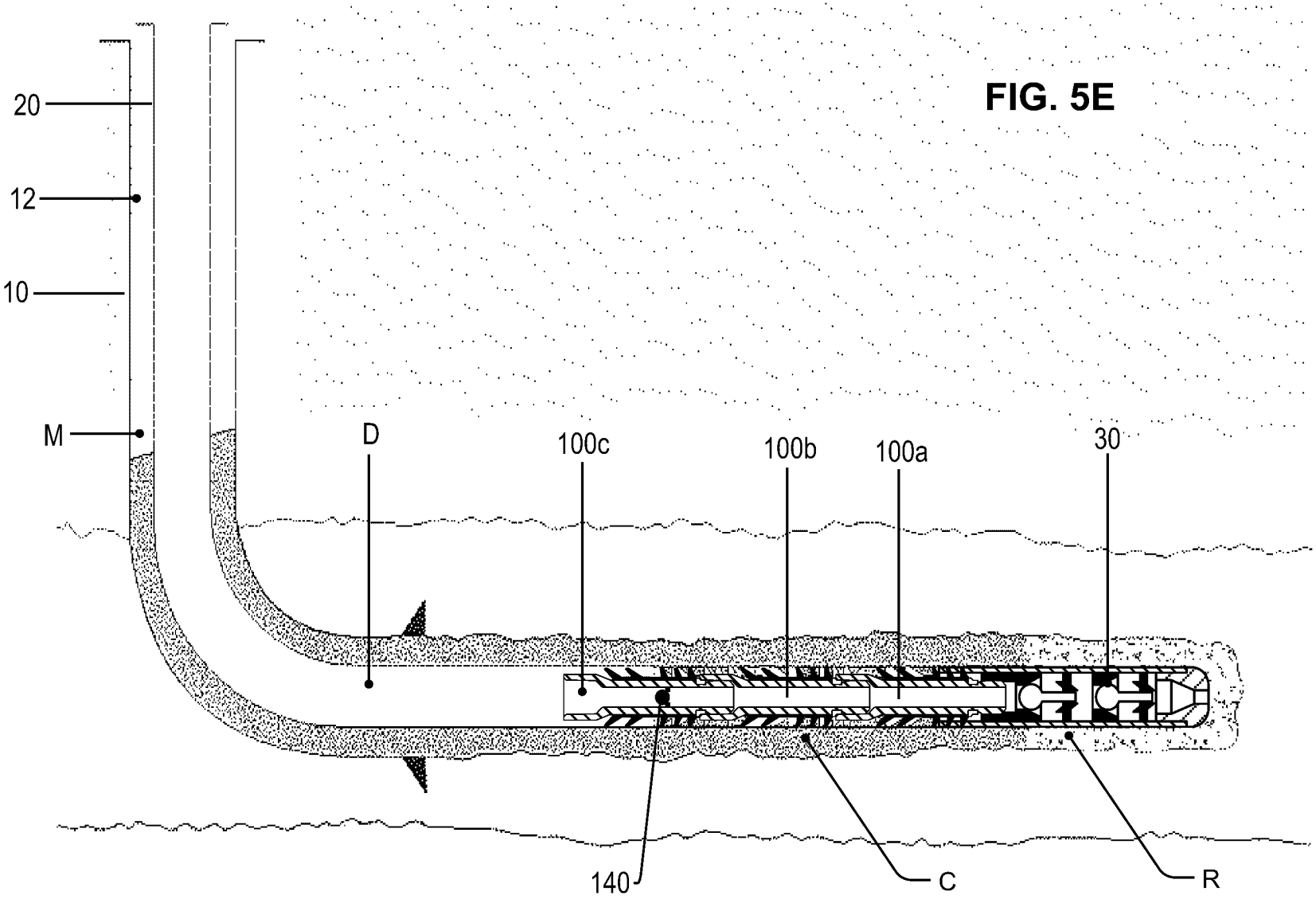
FIG. 5E illustrates a fourth stage of cementing the tubing string in the borehole in which a tubing pressure test is performed.

As shown in FIG. 5E, this final wiper plug 100*c* includes a temporary valve 140 that can allow for a pressure test of the tubing string 20 to be performed. This valve 140 can be similar to that disclosed above with respect to FIGS. 3-4. The displacement fluid (D) is pumped behind the wiper plug 100*c* to build up pressure in the tubing string 20 cemented in the borehole 10 to test the cementing operation. The temporary valve 140 holds the pressure so that the test pressure can be reached. Eventually, the temporary valve 140 will be removed by degrading, disintegrating, or the like in response to a stimulus, such as exposure to the displacement fluid (D). With the valve 140 removed, fluid communication can be established through the tubing string 20, the plugs 100*a-c*, and the float valve 30 to the toe of the borehole 10. This fluid communication allows tools to be pumped down the tubing string 20 so further completion operation can be performed.

As can be seen, pressure applied against the temporary valve 140 can then be used to test the integrity of the cemented tubing string 20 to desired test levels. A full pressure check can be completed by allowing operators to cycle and monitor pressure pumped in the tubing string 20 behind the valve 140 to assess the integrity of the tubing string 20. In turn, the temporary valve 140 is self-removing and will then dissolve away or otherwise be removed. Once the testing is complete and the temporary valve 140 is removed, fluid circulation is re-established through the float valve 30, allowing for other operations to be performed without requiring tubing-conveyed perforating to be performed in the tubing string 20 to open of flow path. For example, wireline perforating guns and composite plugs can be pumped down to begin stimulation operations. If desired, the first stimulation operation can be performed through the float valve 30.

As opposed to the temporary valve 140, the final plug 100*c* can have a configuration as disclosed above with respect to FIG. 2, which allows for a pressure test. Namely, the displacement fluid (D) is pumped behind the wiper plug 100*c* to build up pressure in the tubing string 20 cemented in the borehole 10 to test the cementing operation. The uphole barrier 110 is removed/yields, and the downhole barrier 120 composed of self-removing material holds the pressure so that the test pressure can be reached. Eventually, the downhole barrier 120 will be removed by degrading, disintegrating, or the like in response to a stimulus, such as exposure to the displacement fluid (D). With the downhole barrier 120 removed, fluid communication can be established through the tubing string 20, the plugs 100*a-c*, and the float valve 30 to the toe of the borehole 10. This fluid communication allows tools to be pumped down the tubing string 20 so further completion operation can be performed.

As can be seen, pressure applied against the downhole barrier 120 can then be used to test the integrity of the cemented tubing string 20 to desired test levels. A full pressure check can be completed by allowing operators to cycle and monitor pressure pumped in the tubing string 20 behind the downhole barrier 120 to assess the integrity of the tubing string 20. In turn, the downhole barrier 120 is self-removing and will then dissolve away or otherwise be removed. Once the downhole barrier 120 is removed, fluid circulation is re-established through the float valve 30, allowing for the pump down of perforating guns, composite plugs, and the like for other operations to be performed.

In the assembly of FIGS. 5A-5E, the wiper plugs 100*a-c* use the removable barriers 110, 120 so the cement can be over-displaced in the annulus 12 to create a flow path into the formation at the shoe of the tubing string 20. The multiple wiper plugs 100*a-c* used with the float valve 30 places precisely measured volumes of cement (C) and retarding fluid (R) into the borehole 10. When the cement (C) is set, zonal isolation can be achieved above the float shoe 30, while the retarding fluid (R) at the float valve 30 allows for communication to the formation below to the toe of the borehole 10.

Once the cement job is complete, the cementation equipment (not shown) at surface can be removed from the well. The wiping provided by the wiper plugs 100*a-c* preferably eliminates the need of a cleanup run. Because communication to the formation is established at the shoe, fracturing equipment and a perforating unit can be rigged up to initiate injection through the shoe. Disintegration of the valve 140 allows for bullheading the retarding fluid (R) into the formation below the float valve 30. The perforating guns can be pumped to depth and perforations can be shot as required. Fracturing operations can then commence immediately after the perforating guns are retrieved.

Different types of barriers are contemplated herein for the uphole and downhole barriers 110, 120. Both barriers 110, 120 in the disclosed plug 100 may use the same or different type of barrier. In general, the disclosed barrier 110, 120 can be: a breachable plug that is breached in response to predetermined pressure but not broken into pieces nor freed from the throughbore 104; a frangible barrier that is broken or shattered into small pieces in response to predetermined pressure; a rupture disc that is ruptured or split open in response to predetermined pressure; a shearable plug that shears loose from the throughbore 104 in response to predetermined pressure; a pump-out plug that can be pumped out from obstructing the throughbore 104 in response to predetermined pressure; etc. Either of the barriers 110, 120 can be composed of a self-removable material that removes in response to stimulus as disclosed herein.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A wiper plug for use in downhole pressures, the wiper plug comprising:

a body defining a throughbore from an uphole end to a downhole end;

a downhole barrier disposed in the throughbore toward the downhole end;

an uphole barrier disposed in the throughbore toward the uphole end;

a chamber enclosed in the throughbore between the uphole and downhole barriers and configured to hold an internal pressure lower than the downhole pressures, the uphole barrier being removable in response to a first pressure, the first pressure force being predefined by the internal pressure of the chamber, the downhole barrier being removable; and a temporary valve disposed in the throughbore and having a seat and a ball, the ball being configured to seat in the seat and being self-removing, the temporary valve being configured to at least temporarily prevent pressure communication in the throughbore from the uphole end to the downhole end.

2. The wiper plug of claim 1, further comprising wipers disposed externally on the body.

3. The wiper plug of claim 1, wherein the temporary valve is comprised of a self-removable material being removable in response to a stimulus.

4. The wiper plug of claim 3, wherein the self-removable material is configured to dissolve, erode, disintegrate, or degrade due to heat, temperature, fluid, introduced solvent, applied acid, time, and/or a wellbore condition as the stimulus.

5. The wiper plug of claim 1, wherein the uphole barrier comprises a breachable plug, a frangible barrier, a rupture disc, a shearable plug, or a pump-out barrier; and wherein the downhole barrier comprises a breachable plug, a frangible barrier, a rupture disc, a shearable plug, a pump-out barrier.

6. The wiper plug of claim 1, comprising:

a first seal configured to seal between the uphole barrier and the throughbore; and a second seal configured to seal between the downhole barrier and the throughbore.

7. The wiper plug of claim 1, wherein the downhole barrier is removable in response to a second pressure force; and wherein the first pressure force is configured to be at least greater than the second pressure force.

8. The wiper plug of claim 1, wherein at least a portion of the downhole barrier is comprised of a self-removable material being removable in response to a stimulus introduced through removal of the uphole barrier.

9. The wiper plug of claim 1, wherein the temporary valve comprises a sleeve having the seat and being movable in the throughbore from a first condition to a second condition, the sleeve in the first condition being configured to permit fluid communication in the throughbore from the uphole end to the downhole end past the ball seated in the seat, the sleeve in the second condition being configured to prevent the fluid communication in the throughbore from the uphole end to the downhole end past the ball seated in the seat.

10. A method, comprising:

pumping a wiper plug down tubing;

maintaining an internal pressure chamber in a throughbore of the wiper plug between uphole and downhole barriers;

landing the wiper plug in the tubing;

removing the uphole barrier by applying a first predetermined pressure against the uphole barrier and facilitating removal of the uphole barrier with the internal pressure chamber of the wiper plug;

closing a temporary valve having a seat and a ball disposed in the throughbore, the ball being self-removing;

performing a tubing pressure test by using the ball seated in the seat to at least temporarily prevent pressure communication through the throughbore of the wiper plug;

removing the downhole barrier; and permitting flow through the throughbore of the wiper plug in response to removal of the uphole and downhole barriers and in response to self-removing of the ball of the temporary valve.

11. The method of claim 10, wherein closing the temporary valve comprises closing the temporary valve in response to the flow permitted through the throughbore; and wherein permitting the pressure communication through the throughbore of the wiper plug comprises self-removing a self-removable material of the ball of the temporary valve in response to a stimulus.

12. The method of claim 10, wherein removing the downhole barrier comprises removing the downhole barrier in response to a second predetermined pressure less than or equal to the first predetermined pressure.

13. The method of claim 10, wherein removing the downhole barrier comprises self-removing a self-removable material of the downhole barrier in response to a stimulus introduced through removal of the uphole barrier.

14. The method of claim 10, further comprising:

preceding the wiper plug with an initial wiper plug by pumping the initial wiper plug down the tubing;

maintaining an internal pressure chamber in a throughbore of the initial wiper plug between an uphole barrier and a downhole barrier of the initial wiper plug;

landing the initial wiper plug in the tubing;

removing the uphole barrier of the initial wiper plug by applying a first predetermined pressure against the first uphole barrier and facilitating removal of the uphole barrier with the first internal pressure chamber of the initial wiper plug;

removing the downhole barrier of the initial wiper plug; and permitting flow through the throughbore of the initial wiper plug in response to removal of the uphole and downhole barriers of the initial wiper plug.

15. The method of claim 10, further comprising:

preceding the wiper plug with an initial wiper plug by pumping the initial wiper plug down the tubing;

landing the initial wiper plug in the tubing;

removing at least one barrier in a throughbore of the initial wiper plug by applying an initial predetermined pressure against the at least one barrier; and permitting flow through the throughbore of the initial wiper plug in response to removal of the at least one barrier.

16. The method of claim 15, wherein landing the wiper plug in the tubing comprises landing the wiper plug on the initial wiper plug.

17. The method of claim 10, wherein performing the tubing pressure test comprises performing the tubing pressure test before or after removing the downhole barrier.

18. The method of claim 10, further comprising:

following the wiper plug with a subsequent wiper plug by pumping the subsequent wiper plug down the tubing;

landing the subsequent wiper plug in the tubing;

removing at least one barrier in a throughbore of the subsequent wiper plug by applying an initial predetermined pressure against the at least one barrier; and permitting flow through the throughbore of the subsequent wiper plug in response to removal of the at least one barrier.

19. The method of claim 10, comprising performing a cementing operation for the tubing in a borehole by pumping the wiper plug down the tubing separating an advancing fluid from a following fluid of the cementing operation down the tubing.

20. The method of claim 19, wherein:

the advancing fluid is a spacer fluid and the following fluid is a cement slurry;

the advancing fluid is the cement slurry and the following fluid is a retarding fluid; or the advancing fluid is the retarding fluid and the following fluid is a displacement fluid.

21. The method of claim 10, wherein removing the downhole barrier comprises:

permitting fluid communication in the throughbore from the uphole end to the downhole end past the ball seated in the seat by at least temporarily holding a sleeve in a first condition, the sleeve having the seat and being movable in the throughbore from the first condition to a second condition; and removing the downhole barrier in response to the fluid communication; and wherein performing the tubing pressure test comprises preventing the fluid communication in the throughbore from the uphole end to the downhole end past the ball seated in the seat by moving the sleeve to the second condition.

* * * * *